United States Patent [19]

Penhasi et al.

[11] 4,053,104

[45] Oct. 11, 1977

[54] SELF COOLING TABLE TOP CENTRIFUGE

[75] Inventors: Harry Aron Penhasi, Cupertino; John Francis Whiting Robbins, Los Altos, both of Calif.

[73] Assignee: Beckman Instruments, Inc., Fullerton, Calif.

[21] Appl. No.: 660,446

[22] Filed: Feb. 23, 1976

[51] Int. Cl.[2] ..... B04B 7/02; B04B 15/02

[52] U.S. Cl. ..... 233/11; 233/1 R

[58] Field of Search ..... 233/1 R, 1 B, 11, 27, 233/DIG. 1; 62/412; 55/269, 467, 473

[56] References Cited

U.S. PATENT DOCUMENTS

| | | | |
|---|---|---|---|
| 2,778,566 | 1/1957 | Garrett | 233/11 |
| 2,878,992 | 3/1959 | Pickels et al. | 233/11 |
| [illegible] | 12/1959 | DiBenedetto et al. | 233/11 |
| 3,860,166 | 1/1975 | Anderson | 233/11 |

*Primary Examiner*—George H. Krizmanich
*Attorney, Agent, or Firm*—R. J. Steinmeyer; F. L. Mehlhoff

[57] ABSTRACT

In a table top centrifuge of the type including a rotor and a housing defining a chamber for the rotor, the housing having a removable cover therefor, there is disclosed an improvement wherein the cover has first and second passageways extending entirely there through, from the center and periphery, respectively, thereof to spaced locations on one of the outer surfaces thereof to define inlet and outlet ports, respectively. A refrigeration unit is provided having a cold air outlet port and a warm air inlet port at spaced locations on one of the outer surfaces thereof, the spacing between and orientation of the centrifuge and refrigeration unit inlet and outlet ports being such that positioning of the one outer surfaces of the centrifuge and refrigeration units in contact with each other aligns the outlet and inlet ports of the refrigeration unit with the inlet and outlet ports, respectively, of the centrifuge. This arrangement forms a continuous, recirculating air passageway between the refrigeration unit and the centrifuge chamber with the centifuge rotor acting as the circulating centrifugal blower.

13 Claims, 4 Drawing Figures

SELF COOLING TABLE TOP CENTRIFUGE

BACKGROUND OF THE INVENTION

1. Field of the Invention

The present invention relates to a self cooling table top centrifuge and, more particularly, to a method and apparatus for providing refrigeration capabilities to a table top centrifuge at a lower price and complexity level than available heretofore.

2. Description of the Prior Art

Small, table top centrifuges are used in a clinical lab primarily to separate solid particles such as blood cells and the like from physiological fluids for further processing of either the sediment or the fluid for further processing of either the sediment or the fluid for diagnostic purposes. A typical table top centrifuge includes a rotor positioned within a chamber in a housing, the housing having a cover to enclose the chamber during operation of the rotor. In the case of high speed centrifuges, the chamber is typically evacuated so that the rotor operates in a vacuum. On the other hand, vacuum chambers are not ordinarily used with low speed, table top centrifuges.

Due to the nature of the centrifuging process, i.e. the rotor spinning in an air environment and the resultant friction between the rotor surfaces and the air, the rotor and the sample therein tend to heat up. In many centrifuges, ports are provided to circulate room air through the chamber to limit the temperature rise to a minimum. Even so, within a short period of time, the sample temperature will rise by as much as 10° centigrade over the prevailing room ambient. Quite often, the resuling elevated temperatures may be detrimental to the sample by causing deterioration and/or side reactions affecting further diagnostic tests.

To prevent such occurrences, samples suspected of being temperature sensitive have required much costlier refrigerated floor model centrifuges. In a typical prior art refrigerated centrifuge, the evaporator coils are wrapped directly around the chamber walls to directly cool the walls of the chamber so as to cool the air and the rotor therein through the combined effects of conduction and radiation. However, this causes condensation and frost formation within the chamber and problems such as corrosion, contamination, and curtailed run times due to physical blockage by icing conditions. This latter problem is primarily the result of the necessity of maintaining the chamber walls well below freezing temperatures due to the limited surface area and thus the poor heat transfer conditions available.

SUMMARY OF THE INVENTION

Accordingly to the present invention, these problems are minimized by the provision of a simple, self cooling, table top centrifuge. The present centrifuge has approximately the same level of complexity and approximately the same cost as available table top centrifuges which have no cooling capability. However, with the present design of a centrifuge and the addition of a relatively simple refrigeration unit, cooling can be provided for the centrifuge chamber to prevent elevated temperatures of the rotor and the sample, making the present centrifuge suitable for use with samples which are temperature sensitive. The present invention utilizes a refrigeration technique which is external to the centrifuge chamber, although not necessarily external to the centrifuge housing. Thus, the cooling capacity is limited only by the size of the refrigeration unit desired and the volume of air circulated through the chamber. According to the preferred embodiment, an evaporator is used which is outside of the centrifuge chamber so that condensation and/or frosting occurs only within the refrigeration unit, resulting in a dry, frost free centrifuge operation.

Briefly, it is the teaching of the present invention to provide the lid of a centrifuge with first and second passageways extending entirely therethrough, from the center and periphery, respectively, thereof to spaced locations on one of the outer surfaces thereof to define inlet and outlet ports, respectively, and to provide a refrigeration unit having a cold air outlet port and a warm air inlet port at spaced locations on one of the outer surfaces thereof, the spacing between and orientation of the centrifuge inlet and outlet ports being the same as that of the refrigeration unit outlet and inlet ports, respectively, whereby positioning of the one outer surface of the centrifuge in contact with the one outer surface of the refrigeration unit aligns the outlet and inlet ports of the refrigeration unit with the inlet and the outlet ports, respectively, of the centrifuge thus forming a continuous, recirculating air passageway between the refrigeration unit and the centrifuge chamber. According to the present invention, the centrifuge rotor acts as the circulating centrifugal blower to conduct air from the refrigeration unit through the centrifuge chamber. In one embodiment of the present invention, the refrigeration unit and the centrifuge unit are in separate housings whereas in a second embodiment of the invention, the refrigeration unit is in the housing for the centrifuge chamber.

OBJECTS

It is therefore an object of the present invention to provide a self cooling table top centrifuge.

It is a further object of the present invention to provide a table top centrifuge having refrigeration capabilities at a substantially lower price and level of complexity than available heretofore.

It is a still further object of the present invention to provide a centrifuge utilizing a refrigeration technique external to the centrifugation chamber.

It is another object of the present invention to provide a self cooling table top centrifuge including a centrifuge and a refrigeration unit which are placed side-by-side to form a refrigerated system.

It is still another object of the present invention to provide a centrifuge utilizing a refrigeration technique external to the centrifugation chamber but internal to the centrifuge housing.

Another object of the present invention is the provision of a centrifuge having a lid which allows air circulation in and out of the centrifuge chamber where the centrifuge rotor acts as the circulating centrifugal blower.

Still other objects, features, and attendant advantages of the present invention will become apparent to those skilled in the art from a reading of the following detailed description of the preferred embodiment constructed in accordance therewith, taken in conjunction with the accompanying drawings wherein the like numerals designate like parts in the several figures and wherein:

DESCRIPTION OF THE PREFERRED EMBODIMENTS

Figure 1:
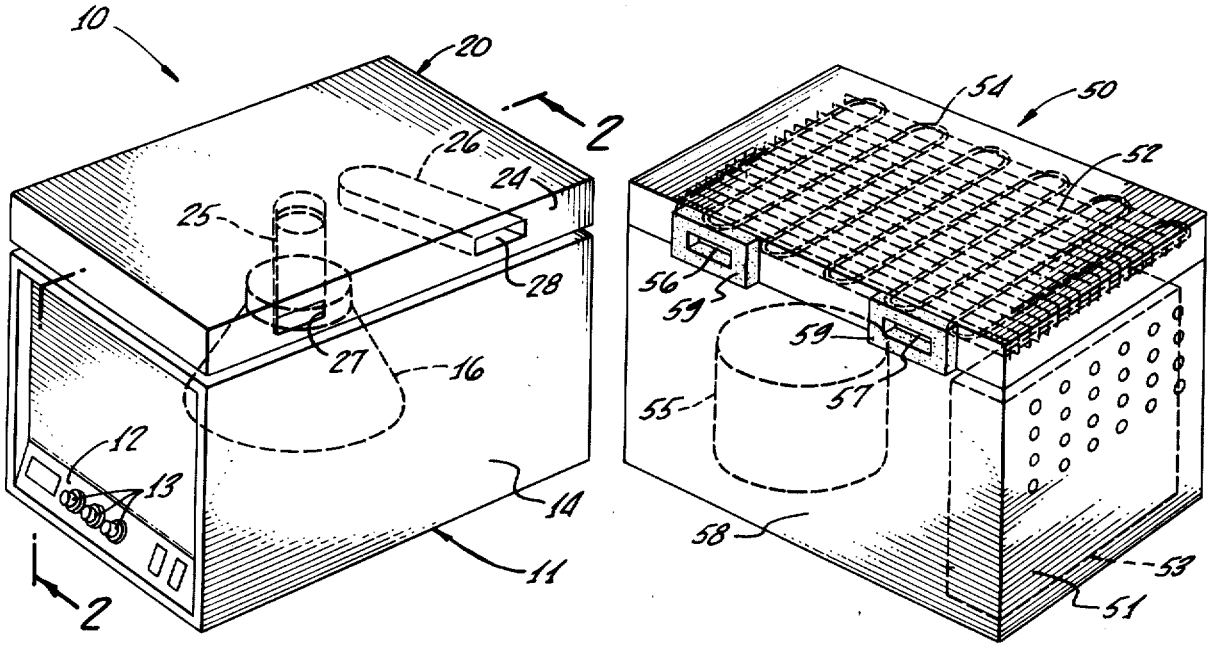
FIG. 1 is a perspective view of the separate centrifuge and refrigeration units constructed in accordance with the present invention.
Figure 2:
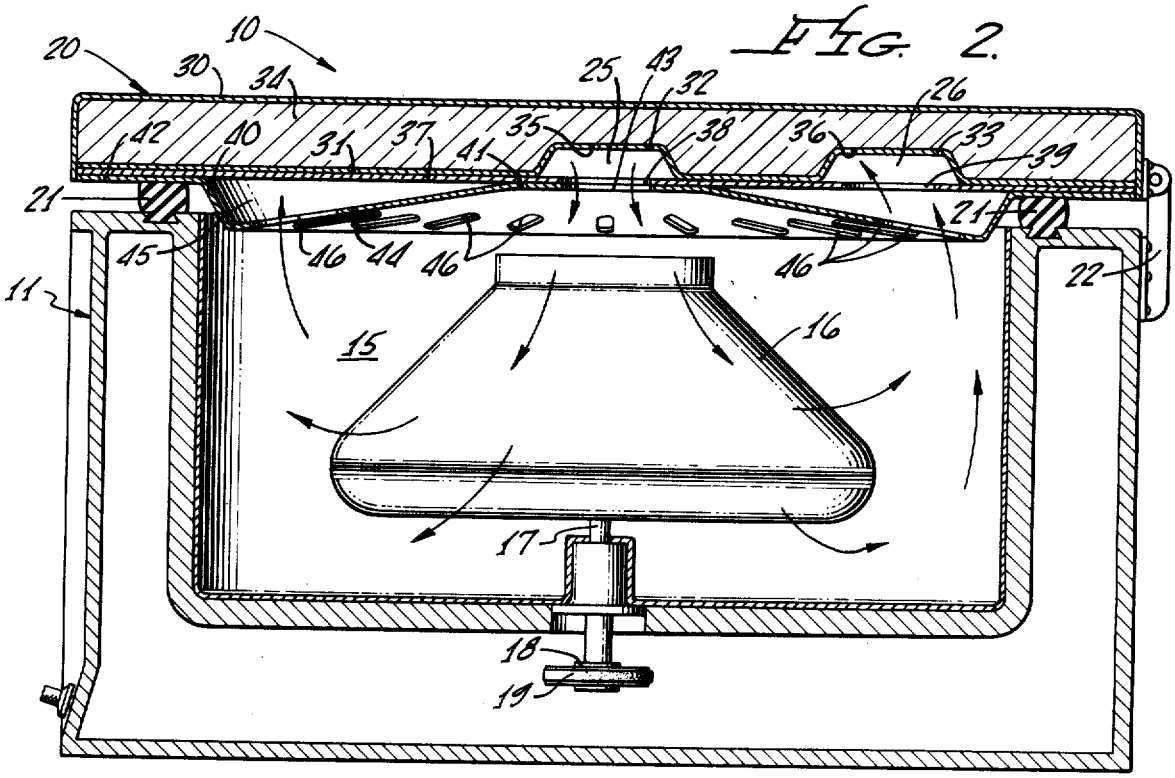
FIG. 2 is an enlarged sectional view taken along the line 2—2 in FIG. 1.

Referring now to the drawings and, more particularly, to FIGS. 1 and 2 thereof, the present centrifuge, generally designated 10, is generally similar to known centrifuges and includes a housing 11 having a front panel 12 including a plurality of controls 13 and at least one side 14. Housing 11 defines a chamber 15 which is open at the top thereof for providing access thereinto. Mounted within chamber 15 is a rotor 16 which may be of any of the well-known types available to those skilled in the art. Rotor 16 rests on a drive shaft 17 which extends into chamber 15, from the bottom thereof, coaxial with the center of chamber 15. The lower end of drive shaft 17 extends into housing 11 and may include a pulley 18 connectable by a belt 19 to a drive source (not shown).

Centrifuge 10 also includes a cover or lid 20 for enclosing chamber 15 during the operation of centrifuge 10. For this purpose, the upper surface of housing 11 may include a gasket 21, surrounding chamber 15, on which cover 20 rests. Cover 20 may be removable or may be hingedly connected to housing 11 by means of one or more hinges 22.

According to the present invention, centrifuge 10 has first and second passageways 25 and 26 extending entirely through cover 20 for conducting air into and out of chamber 15. The external or first ends of passageways 25 and 26 terminate at spaced locations on the outer surface 24 of cover 20 which is adjacent side 14 of housing 11 to define inlet and outlet ports 27 and 28, respectively. The inner or second ends of passageways 25 and 26 communicate with chamber 15, adjacent the center and periphery, respectively, thereof.

Figure 3:
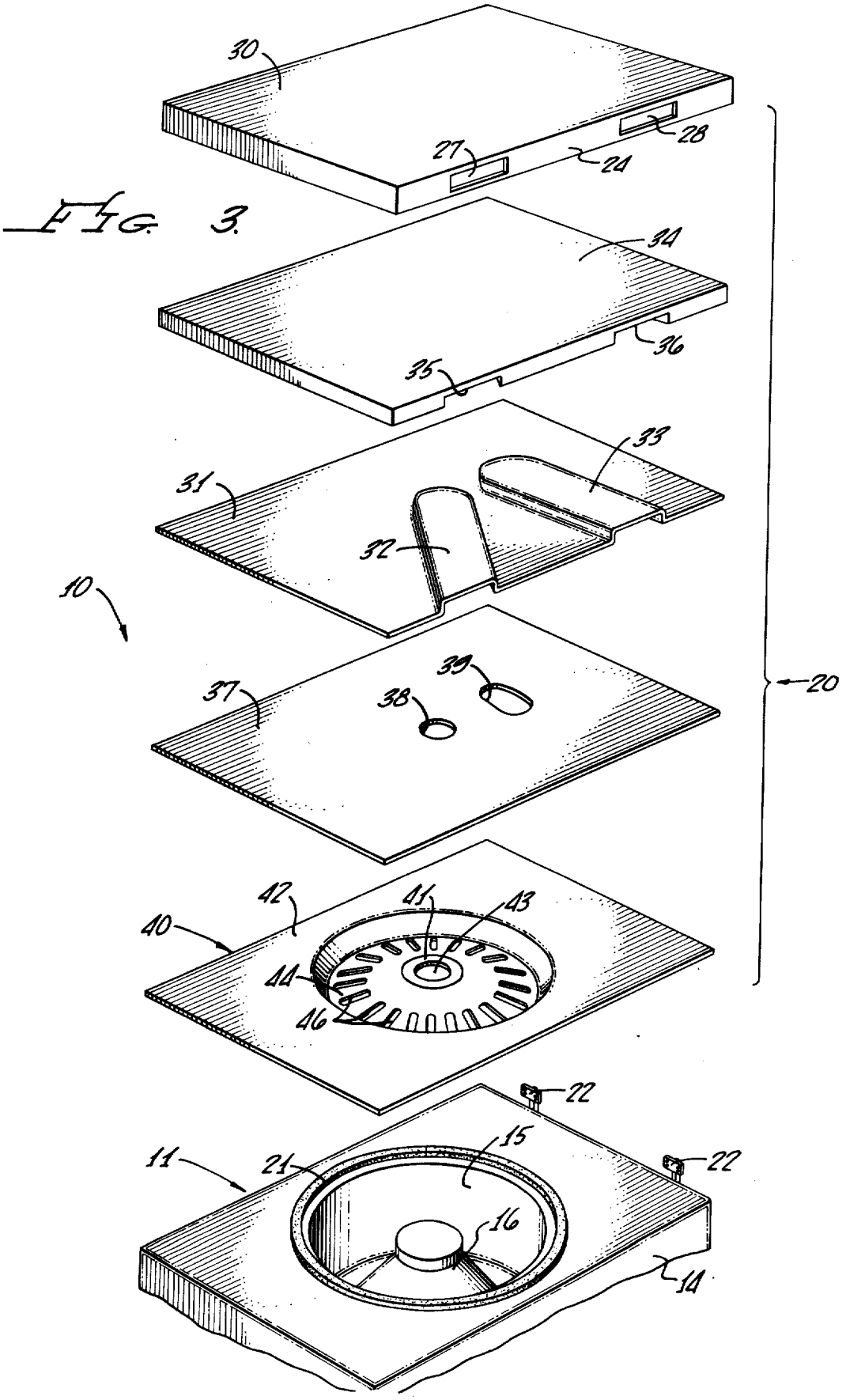
FIG. 3 is an exploded perspective view of the cover and the centrifuge housing of FIGS. 1 and 2.

More particularly, and referring now to FIGS. 2 and 3, cover 20 includes an outer shell 30 having four sides including side 24 which has spaced openings 27 and 28 therein. Cover 20 also includes a planar duct panel 31 having first and second raised portions 32 and 33. When positioned in contact with the outer edges of the sides of shell 30, first or external ends of raised portions 32 and 33 are aligned with openings 27 and 28, respectively, in side 24 of shell 30. The inner or second end of raised portion 32 terminates at the center of shell 30 whereas the internal or second end of raised portion 33 terminates at a point spaced from the center of shell 30, at a point which will be aligned with the periphery of chamber 15 in housing 11 when cover 20 is closed. Positioned between shell 30 and duct panel 31 is a panel 34 of molded or flexible insulating material having channels 35 and 36 therein which have the same configuration as raised portions 32 and 33, respectively, in duct panel 31 for respect of same, as shown in FIG. 2.

Cover 20 also includes a divider panel 37 having the same general dimensions as duct panel 31 and adapted to be positioned in contact therewith. Divider panel 37 has holes 38 and 39 therein which are aligned with the inner or second ends of raised portions 32 and 33, respectively, in duct panel 31. The holes 38 and 39 of the divider panel 37 cooperate with the raised portions 32 and 33 to form openings from the interior of the chamber communicating with the inner or second ends of passageways 25 and 26.

Cover 20 also includes a molded lower panel 40 having coplanar central and outer portions 41 and 42, respectively, which are adapted to be positioned in contact with divider panel 37. Central portion 41 of panel 40 has a hole 43 therein which is aligned with hole 38 in divider panel 37. Between portions 41 and 42 of panel 40 is a recessed circular portion 44 which, together with divider panel 37, defines a circular channel or plenum 45 between panels 37 and 40. Hole 39 in divider panel 37 is aligned with plenum 45. Portion 44 of lower panel 40 has a plurality of radial slots 46 therein which are aligned with the periphery of chamber 15 in housing 11 when cover 20 is closed. Shell 30 and panels 31, 34, 37, and 40 may be interconnected in any convenient manner, such as by mechanical pressure, bonding, gluing, or the like.

According to one embodiment of the present invention, and referring now to FIG. 1, there is also provided a separate refrigeration unit, generally designated 50, of conventional construction and operation. Refrigeration unit 50 is quite similar to those found in conventional frost free refrigerators and includes a housing 51 which encloses a pair of heat exchangers 52 and 53 and a compressor 55. Heat exchangers 52 and 53 are connected in refrigerant flow relationship to compressor 55 by suitable tubing, that portion of which which extends through heat exchanger 52 being shown at 54.

As is well known to those skilled in the art, heat exchanger 52 operates as an evaporator to extract heat from the air circulated therethrough while heat exchanger 53 operates a condensor to discharge heat taken up to the refrigerant flowing through evaporator 52 to the air circulated through condensor 53. Suitable means (not shown) are provided for providing a pressure drop between condensor 53 and evaporator 52 to promote vaporization of the refrigerant flowing from condensor 53 to evaporator 52. A fan (not shown), is usually also provided for circulating air through condensor 53.

According to the present invention, refrigeration unit 50 is modified to provide evaporator 52 with inlet and outlet ports 56 and 57, respectively, on one side 58 of housing 51. Gaskets 59 may be provided around ports 56 and 57 for reasons which will appear more fully hereinafter. For present purposes, it should be noted that the spacing between, height of, and orientation of inlet and outlet ports 56 and 57, respectively, of refrigeration unit 50 are the same as the spacing between, height of, and orientation of outlet and inlet ports 28 and 27, respectively, of centrifuge 10.

OPERATION

Duct panel 31, divider panel 37, and lower panel 40 define passageways 25 and 26 in cover 20 so as to provide a continuous air passageway from inlet port 27 to outlet port 28 via chamber 15. More particularly, air entering inlet port 27 of cover 30 passes into passageway 25 formed between raised portion 32 of duct panel 31 and divider panel 37 and passes down through aligned holes 38 and 43 in divider panel 37 and lower panel 40, respectively, and enters the center of chamber 15, coaxial with the axis of rotation of rotor 16. When rotating, rotor 16 acts as an impeller, producing an area of low pressure at the center of chamber 15 and an area of high pressure at the periphery thereof. Air is therefore drawn from inlet port 27 into the center of chamber 15 and is delivered at a higher pressure at the periphery thereof where it passes upwardly through radial slots 46 in panel 40 into plenum 45 formed between circular portion 44 of lower panel 40 and divider panel 37. From plenum 45, the air passes upwardly through hole 39 in divider panel 37 and into passageway 26 formed between divider panel 37 and raised portion 33 of duct panel 31. From passageway 26, the air is delivered to outlet port 28. In other words, cover 20 allows air circulation into and out of the centrifugation chamber 15, utilizing the centrifugal blower effect of the spinning rotor 16 as the air prime mover.

FIG. 1 shows centrifuge 10 separated from refrigeration unit 50. However, upon positioning of side 58 of housing 51 of refrigeration unit 50 in contact with side 14 of housing 11 of centrifuge 10, outlet and inlet ports 57 and 56, respectively, of refrigeration unit 50 become aligned with inlet and outlet ports 27 and 28, respectively, of centrifuge 10. Gaskets 59 are provided to seal the area between housings 11 and 51 to provide a continuous air circulation path. Thus, the air expelled from outlet port 28 of centrifuge 10 is conducted past coils 54 of evaporator 52 and the resultant cool air is expelled from outlet port 57 into inlet port 27 of centrifuge 10. Therefore, centrifuge 10 and refrigeration unit 50 form a continuous recirculating air passageway between evaporator 42 and chamber 15, with rotor 16 acting as the circulating centrifugal blower.

DESCRIPTION OF THE ALTERNATE EMBODIMENT

Figure 4:
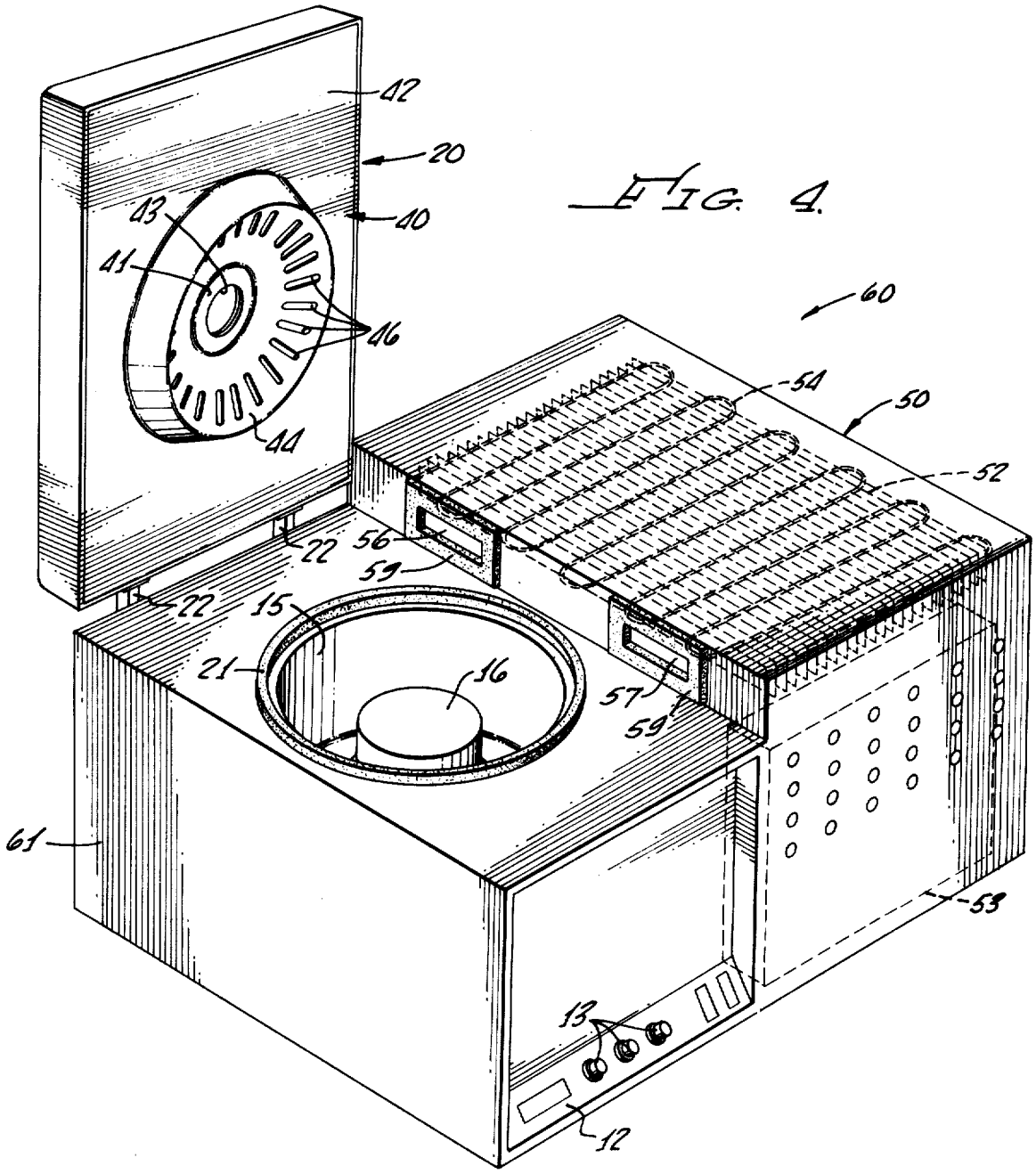
FIG. 4 is a perspective view of another embodiment of the present invention wherein the centrifuge and the refrigeration units are incorporated into a common housing.

Referring now to FIG. 4, there is shown a second embodiment of centrifuge, generally designated 60, constructed in accordance with the teachings of the present invention. While two separate packages, i.e. a centrifuge 10 and a refrigeration unit 50 were shown in the embodiment of FIGS. 1-3, such a showing was for convenience only. In the case of the embodiment of FIG. 4, refrigeration unit 50 is incorporated into centrifuge 60 and only a single housing 61 is required. Since the embodiment of FIG. 4 is otherwise in all material respects identical to the embodiment of FIGS. 1-3, the same numbers have been utilized to indicate the same or corresponding parts.

More particularly, housing 61 of centrifuge 60 has a front panel 12 including a plurality of controls 13, housing 61 defining a chamber 15 which is open at the top thereof for providing access thereinto. Mounted within chamber 15 is a rotor 16 which may be any of the well known types available to those skilled in the art. Centrifuge 60 also includes a cover or lid 20 for enclosing chamber 15 during the operation of rotor 16, lid 20 being identical to lid 20 of centrifuge 10. Furthermore, the upper surface of housing 61 may include a gasket 21, surrounding chamber 15, on which cover 20 rests. Cover 20 may be removable or may be hingedly connected to housing 61 by means of one or more hinges 22.

As described more fully with regard to centrifuge described in FIGS. 1-3, cover 20 has first and second passageways (not shown) extending entirely therethrough for conducting air into and out of chamber 15. The inner or second ends of such passageways terminate in chamber 15, adjacent the center and periphery, respectively, thereof. Shown in FIG. 4 is lower panel 40 of cover 20 which has coplanar central and outer portions 41 and 42, respectively, which define the bottom of cover 20. Central portion 41 of panel 40 has a hole 43 therein which provides the air inlet for chamber 15. Between portions 41 and 42 of panel 40 is a recessed circular portion 44 which has a plurality of radial slots 46 therein which define the air outlet for chamber 15. The external or first ends of the first and second passageways terminate at spaced locations on the side of cover 20 not shown in FIG. 4 to define inlet and outlet ports, respectively.

According to the embodiment of the invention shown in FIG. 4, housing 61 is enlarged laterally to provide room for refrigeration unit 50 which is identical to refrigeration unit 50 of the embodiment of FIGS. 1-3. Refrigeration unit 50 includes a pair of heat exchangers 52 and 53 connected in refrigerant flow relationship to a compressor by suitable tubing 54.

According to the embodiment of FIG. 4, the side of housing 61 which houses refrigeration unit 50 is taller than the side thereof which houses chamber 15 when cover 20 is removed, the two sides of housing 61 having the same height with cover 20 in place. The top of that side of housing 61 which encloses refrigeration unit 50 includes inlet and outlet ports 56 and 57, respectively, on the side thereof facing cover 20. Gaskets 59 may be provided around ports 56 and 57. As was the case in the embodiment of FIGS. 1-3, the spacing between and orientation of inlet and outelt ports 56 and 57 of refrigeration unit 50 are the same as the spacing between and orientation of the outlet and inlet ports, respectively, in cover 20.

OPERATION

As described previously, cover 20 of centrifuge 60 incorporates passageways which provide a continuous air passageway from the inlet port to the outlet port thereof via chamber 15. With cover 20 closed, such inlet and outlet ports are aligned with outlet and inlet ports 57 and 56, respectively, of refrigeration unit 50, with gaskets 59 providing a seal so as to provide a continuous air circulation path. When rotating, rotor 16 acts as an impeller to draw air from the inlet port of cover 20 into the center of chamber 15 and to deliver it at a higher pressure at the periphery thereof where it passes upwardly through radial slots 46 in panel 40 to the outlet port of cover 20. The air expelled from the outlet port of cover 20 is conducted past coils 54 of evaporator 52 and the resultant cool air is expelled from outlet port 57 into the inlet port of cover 20.

It can therefore be seen that according to the present invention, there are provided simple, self cooling, table top centrifuges 10 and 60. Centrifuge 10 has approximately the same level of complexity and approximately the same cost as available table top centrifuges which have no cooling capability. However, with the present design of centrifuge 10 and the addition of a relatively simple refrigeration unit 50, cooling can be provided for chamber 15 to prevent elevated temperatures of rotor 16, making centrifuge 10 suitable for use with samples which are temperature sensitive.

Centrifuges 10 and 60 utilize a refrigeration technique external to chamber 15. Thus, the cooling capacity is limited only by the size of refrigeration unit 50 and the volume of air circulated through chamber 15. Furthermore, since, in this type of system, the coldest spot is evaporator 52 and this is outside of chamber 15, whether or not in a common housing, condensation and/or frosting occurs only within refrigeration unit 50, thus resulting in a dry, frost free centrifuge operation. Furthermore, refrigeration unit 50 may be designed to cycle thermostatically, as is well known in conventional frost free refrigerators, thereby defrosting itself cyclically and eliminating the time limitation due to ice blockage, as in prior designs.

A still further advantage flows from the use of a refrigeration unit external to chamber 15. That is, refrigeration unit 50 may be designed to have an oversized heat transfer capability so that the initial "pull down" is much more rapid, resulting in cold sample temperatures a lot faster than available with prior units. This eliminates precooling of the rotor and samples as has been required heretofore. Still further, both of the present embodiments provide a totally closed system, eliminating the possibility of contaminants escaping to the surrounding room as in room air-cooled units.

While the invention has been described with respect to the preferred physical embodiments constructed in accordance therewith, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

We claim:

1. In a centrifuge including a rotor and a housing defining a chamber of said rotor, the improvement comprising:

a refrigeration unit having a cold air outlet and a warm air inlet to the evaporator of said unit;

first and second passageways extending through said centrifuge housing, first ends of said first and second passageways terminating external to said chamber and being adapted to be connected to said cold air outlet and warm air inlet, respectively, of said refrigeration unit, the second end of said first passageway terminating internally of said chamber, adjacent the axis of rotation of said rotor, the second end of said second passageway terminating internally of said chamber, adjacent the periphery thereof, said rotor conducting air from said first passageway to said second passageway via said chamber.

2. In the centrifuge according to claim 1, the improvement wherein said second end of said second passageway terminates at a plurality of spaced locations around the periphery of said chamber.

3. In a centrifuge according to claim 1 wherein said housing includes a removable cover, the improvement wherein said first and second passageways extend through said cover.

4. In a centrifuge according to claim 3, the improvement wherein said cover includes a plenum aligned with said periphery of said chamber, said plenum having a plurality of openings therein to permit air flow from said chamber to said plenum, said second end of said second passageway terminating in said plenum.

5. In a centrifuge according to claim 1, the improvement wherein said refrigeration unit is in a housing separate from said centrifuge housing and said cold air outlet and warm air inlet to said evaporator of said refrigeration unit exit from said housing of said refrigeration unit on one side thereof and are aligned respectively with said first ends of said first and second passageways terminating external to said rotor chamber in said centrifuge housing.

6. In a centrifuge according to claim 1, the improvement wherein said refrigeration unit is incorporated within said centrifuge housing.

7. In a centrifuge apparatus including a rotor and a housing defining a chamber for said rotor, a method for conducting cooling air through said chamber comprising:

providing a continuous air passageway through said housing, into said chamber, a first portion of said passageway entering the center of said chamber and a second portion of said passageway entering the periphery of said chamber, said rotor acting as an impeller to draw air from said first portion of said passageway and delivering air to said second portion of said passageway.

8. A centrifuge comprising:

a rotor; and housing means defining an enclosed chamber for said rotor, said rotor being positioned in said chamber with the axis of rotation thereof in the center of said chamber, said housing having first and second passageways extending entirely therethrough from the center and periphery, respectively, thereof to spaced locations external to said chamber, said centrifuge rotor acting as a circulating centrifugal blower of circulating air from said first passageway to said second passageway via said chamber.

9. A centrifuge according to claim 8 wherein said housing means includes a cover and wherein said first and second passageways extend through said cover.

10. A centrifuge according to claim 9 wherein said cover has a circular channel formed therein and a plurality of openings connecting said circular channel with said periphery of said chamber, said second passageway terminating in said circular channel.

11. A centrifuge apparatus comprising:

a centrifuge according to claim 8, said housing further defining a chamber for a refrigeration unit; and a refrigeration unit in said refrigeration chamber in said housing, said refrigeration unit having a cold air outlet and a warm air inlet connectable to said first and second passageways, respectively, through said housing thereby forming a continuous recirculating air passageway between said refrigeration unit and said centrifuge chamber with said centrifuge rotor acting as the circulating centrifugal blower.

12. A centrifuge apparatus comprising:

a centrifuge according to claim 8, said first and second passageways terminating at spaced locations on one of the outer surfaces of said housing means to define inlet and outlet ports, respectively; and a refrigeration unit having a cold air outlet port and a warm air inlet port as spaced locations on one of the outer surfaces thereof, the spacing between and orientation of said centrifuge inlet and outlet ports being the same as the spacing between and orientation of said refrigeration unit outlet and inlet ports, respectively, whereby positioning of said one surface of said centrifuge in contact with said one surface of said refrigeration unit aligns said outlet and inlet ports of said refrigeration unit with said inlet and outlet ports, respectively, of said centrifuge thereby forming a continuous recirculating air passageway between said refrigeration unit and said centrifuge chamber with said centrifuge rotor acting as the circulating centrifugal blower.

13. A centrifuge apparatus comprising:

a centrifuge according to claim 8; and refrigeration means having a cold air outlet and a warm air inlet being connected to said first and second passageways, respectively, of said centrifuge to form a continuous air passageway between said refrigeration means and said centrifuge chamber.

* * * * *